US008226999B2

(12) United States Patent
Roberts et al.

(10) Patent No.: US 8,226,999 B2
(45) **Date of Patent: *Jul. 24, 2012**

(54) MICROWAVEABLE NESTED TRAYS

(75) Inventors: Iain Roberts, Chicago, IL (US); Eleanor Luna, San Francisco, CA (US); George Kyaw Soe Maung Aye, Chicago, IL (US); Jeewon Jung, Cambridge, MA (US); Giancarlo Tedeschi, Fidenza (IT); Valentina Masotti, Parma (IT); Francesca Passoni, Chicago, IL (US); Giancarlo Minervini, Chicago, IL (US); Daniela Riniker, Hoffman Estates, IL (US); Sue Lai, Chicago, IL (US); Jennifer Mehlman, Highland Park, IL (US); Jennifer Mitkal, Chicago, IL (US); Michele Amigoni, Salsomaggiore Termg (IT); Andrea Bordini, Parma (IT)

(73) Assignee: Barilla G. E R Fratelli S.p.A., Parma (IT)

( * ) Notice: Subject to any disclaimer, the term of this patent is extended or adjusted under 35 U.S.C. 154(b) by 280 days.

This patent is subject to a terminal disclaimer.

(21) Appl. No.: 12/783,651

(22) Filed: May 20, 2010

(65) Prior Publication Data

US 2010/0282636 A1 Nov. 11, 2010

Related U.S. Application Data

(63) Continuation-in-part of application No. 12/261,642, filed on Oct. 30, 2008, now Pat. No. 7,722,907, which is a continuation-in-part of application No. 12/275,685, filed on Nov. 21, 2008.

(60) Provisional application No. 61/022,399, filed on Jan. 21, 2008.

(51) Int. Cl.
*B65D 81/34* (2006.01)

(52) U.S. Cl. ..... 426/114; 426/120; 426/128; 206/499; 220/23.87; 220/527; 220/528; 220/529; 219/725; 219/734

(58) Field of Classification Search ..... 426/112–114, 426/119, 120, 128; 206/499; 220/527–529, 220/23.87; 219/725, 734
See application file for complete search history.

(56) References Cited

U.S. PATENT DOCUMENTS 2,965,501 A 12/1960 Harriss
3,240,610 A * 3/1966 Cease ..... 426/113
(Continued)

FOREIGN PATENT DOCUMENTS

FR 2855817 A1 12/2004
(Continued)

*Primary Examiner* — Drew E Becker
(74) *Attorney, Agent, or Firm* — Adam K. Sacharoff

(57) ABSTRACT

One embodiment includes a package system containing a main container with a smaller container nested in it. The smaller container is filled with a secondary food item designed to be mixed into the primary food item. The smaller container is placed within the main container. The area of the main container not occupied by the smaller container includes a main food item. Both containers are sealed with one film. Before consumption, a consumer will place the package in a microwave to heat. Once heated, the smaller container is removed from the main container, creating space in the main container previously occupied by the smaller container. The main food item in the main container will re-position creating space between the top of the main food item to the edge of the main container. The secondary item can be added into the main container without overflowing out of the main container.

9 Claims, 8 Drawing Sheets

U.S. PATENT DOCUMENTS

| | | | | | |
|---|---|---|---|---|---|
| 3,442,425 | A | | 5/1969 | Hutson et al. | |
| 3,819,080 | A | | 6/1974 | Bird | |
| 3,985,990 | A | * | 10/1976 | Levinson | 219/729 |
| 4,486,640 | A | * | 12/1984 | Bowen et al. | 219/729 |
| 4,848,579 | A | | 7/1989 | Barnes et al. | |
| D304,658 | S | | 11/1989 | Mattei | |
| 4,916,280 | A | | 4/1990 | Havette | |
| 4,925,684 | A | | 5/1990 | Simon | |
| D312,189 | S | | 11/1990 | Noel | |
| 5,315,083 | A | | 5/1994 | Green | |
| 5,441,707 | A | * | 8/1995 | Lewis et al. | 422/300 |
| D408,686 | S | | 4/1999 | Lillelund et al. | |
| D568,111 | S | | 5/2008 | Epstein | |
| D607,275 | S | | 1/2010 | Griffith | |
| 7,722,907 | B2 | * | 5/2010 | Roberts et al. | 426/107 |
| 2007/0090107 | A1 | * | 4/2007 | White | 220/23.87 |
| 2007/0116807 | A1 | | 5/2007 | Parsons | |
| 2009/0022858 | A1 | | 1/2009 | Pawlick | |
| 2009/0142455 | A1 | | 6/2009 | Parsons | |
| 2009/0186131 | A1 | * | 7/2009 | Roberts et al. | 426/114 |
| 2010/0015293 | A1 | * | 1/2010 | Shapiro et al. | 426/87 |
| 2011/0259897 | A1 | * | 10/2011 | Coursey et al. | 220/592.03 |

FOREIGN PATENT DOCUMENTS

| | | | |
|---|---|---|---|
| GB | 2242410 | A1 | 10/1991 |

* cited by examiner

MICROWAVEABLE NESTED TRAYS

CROSS REFERENCE TO RELATED APPLICATIONS

This application is a continuation in part of U.S. patent application Ser. No. 12/261,642 filed Oct. 30, 2008, which claims priority to U.S. Provisional Application 61/022,399. This application is also a continuation in part of U.S. patent application Ser. No. 12/275,685 filed Nov. 21, 2008, which also claims priority to U.S. Provisional Application 61/022,399.

FIELD OF THE INVENTION

The present invention relates to a container for cooking and preparing foods in a microwave with nested trays, one of which is removed after cooking to provide extra space for combining and mixing the contents.

BACKGROUND OF THE INVENTION

Convenient packaged foods, such as microwaveable meals, are often packaged in a container such as a bowl or a tray. Consumers simply place the container and the contents in a microwave oven to warm up the food, stir the content uniformly, and then consume it. In most instances that require the mixing or stirring of food with another food item or sauce, the secondary item is packaged or already mixed with the main food, or in a separate pouch. The two food items are then combined and/or mixed together. There are disadvantages with this type of pre-packaged cooking.

One disadvantage is that the in order to produce high quality packaged food, any liquid component(s) of the meal should be separated from other components of the meal during product shelf life. For example, to produce a high quality pasta meal, the pasta sauce should be separated from the pasta so that the pasta will maintain its desired texture. If the sauce is contained in a separate pouch, when the pouch is added to the pasta, the pasta and sauce combined does not provide much more for mixing without the food spilling out of the container.

While one solution would be to package the food with extra head space, processing typically requires the container to be fully filled with food without much head space in the package to achieve effective thermal treatment. This creates an issue when consumers attempt to add other components of the meal (e.g. pasta sauce, vegetables, or meats) to the container to create a meal since adding the other components to a container full of food will cause overflow of the mixed items. Stirring the combined items uniformly is extremely difficult without spilling. In addition, since the food is hot, it could produce a dangerous situation if the hot food touches a person's skin.

It would be highly desirable to avoid this problem, yet maintain a container that is capable of microwave cooking food items. The present invention solves this problem.

SUMMARY OF THE INVENTION

In accordance with the present invention a package system containing two components is employed. The package includes a main container with a smaller container nested in it. The smaller container is filled with a secondary food item designed to be mixed into the primary food item in the main container. The smaller container is placed within the main container. The area of the main container not occupied by the smaller container will include a main food item. Both containers are then sealed with one film and can go through desired thermal process. Before consumption, a consumer will place the package in a microwave to warm up the contents. Once heated, the secondary item in the smaller container is removed from the main container, which creates a space in the main container previously occupied by the smaller container. The main food item in the main container will then re-position creating a head space between the top of the main food item to the edge of the main container. The secondary item can then be added into the main container without overflowing out of the main container. The main and secondary item contents (e.g. pasta, sauce, and vegetables) can finally be mixed without spilling.

In one embodiment of the present invention there is provided, a microwavable container system. The container system includes a base container and a tray. The tray is disposed within a first portion of a base interior cavity defined by the base container. A second portion of the base interior cavity that is not occupied by the tray includes a first food component, and wherein the tray interior cavity includes a second food component, that are combinable after microwave cooking by removing the tray from the base interior cavity and adding the second food component with the first food component in the base interior cavity which becomes larger with the removal of the tray.

In another aspect of the embodiment, the base container includes an upper outwardly turned edge around a perimeter of the base container and includes a ledge defined around one portion of an inner periphery adjacent the outwardly turned edge. The tray includes an upper outwardly turned edge that is defined to rest on the ledge when the tray is disposed within the first portion of the base interior cavity of the base container.

In another aspect of the embodiment, the tray includes a notch in one end of the outwardly turned edge and the base container includes a pair of oval shaped ends to define handles. Thus, the notch in one end of the outwardly turned edge of the tray may be located such that the notch is positioned by a handle in the base container when the tray is disposed within the first portion of the base interior cavity of the base container.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
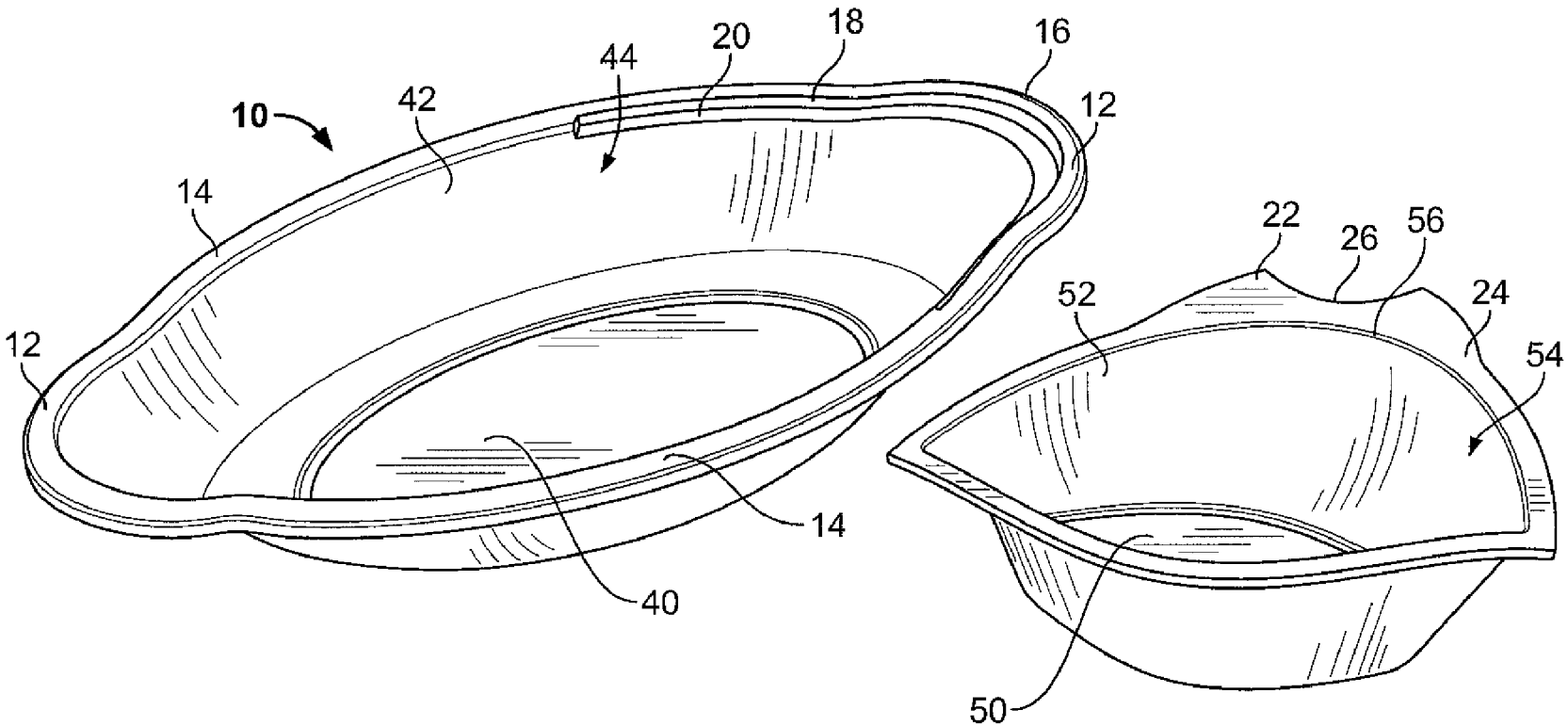
FIG. 1 is a perspective view of the containers in an empty state and separated from one another.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
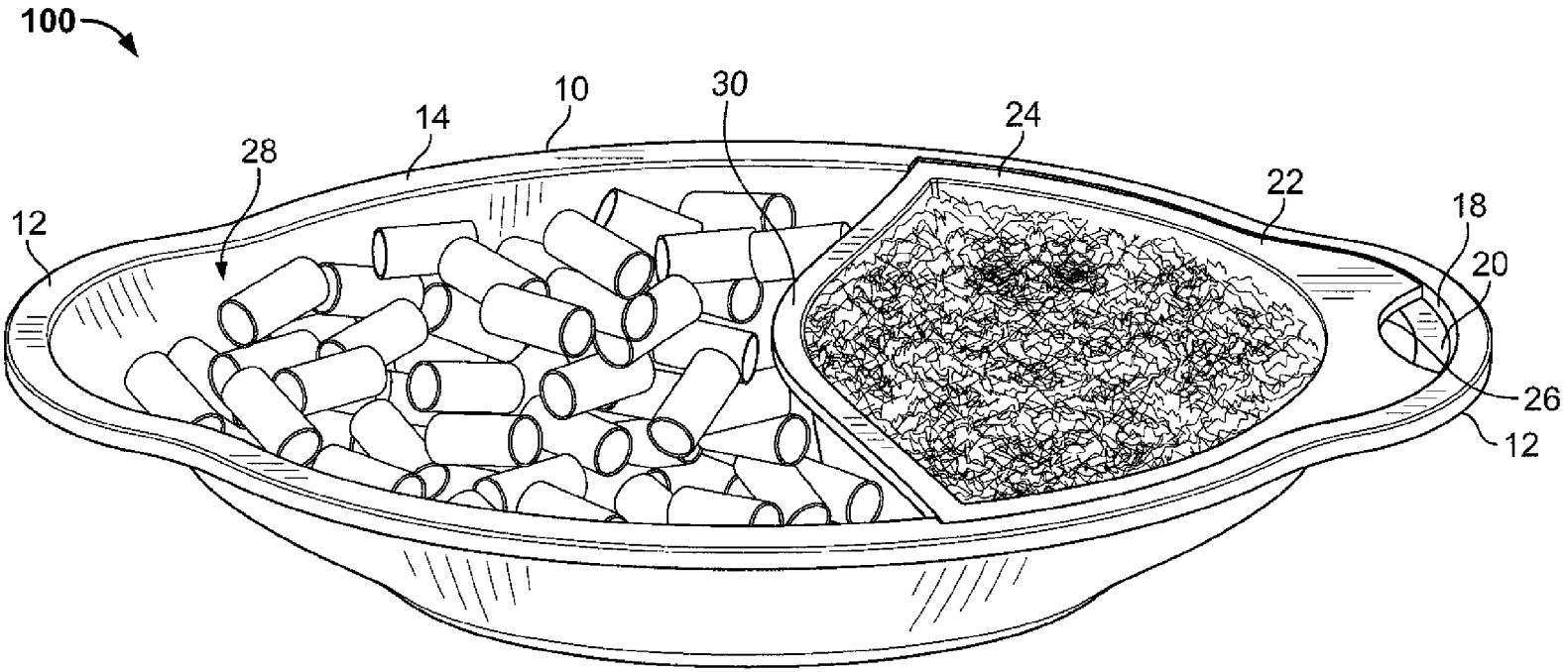
FIG. 2 is a perspective view of an embodiment in accordance with the present invention showing the smaller container with a secondary food item nested within the main container with a main food item.

Referring now to FIGS. 1 through 4, there is shown nested microwaveable trays. The trays are made from typical microwaveable material that helps aids cooking of the contents in a microwaveable oven. The embodiment includes a main container 10 that includes a pair of handles 12 on either end of the container 10. The container 10 includes a bottom portion 40 which extends into side walls 42. The side walls 42 eventually turn outwardly to define an upper edge 14 around the perimeter of the container 10. This defines an interior cavity 44. On one end 16 of the container 10 there is provided around the inner periphery 18 of the upper edge 14 a ledge 20. The ledge 20 allows a smaller container 22 to be nested within the main container 10 (as shown in FIG. 2).

The smaller container 22 includes a bottom portion 50 which extends into side walls 52, to define an interior cavity 54. The side walls 42 also turn outwardly (at least along a portion thereof) to define an edge 24 that is shaped to fit on and be supported by the ledge 20. The smaller container 22 also includes a notch 26 at an end 56 and in the edge 24 such that when the smaller container 22 is positioned within the main container 10, the notch 26 provides for an opening near the handle end 12. The opening allows for a user's finger to be inserted such that the smaller container 22 can be easily removed from the main container (as described below).

Figure 3:
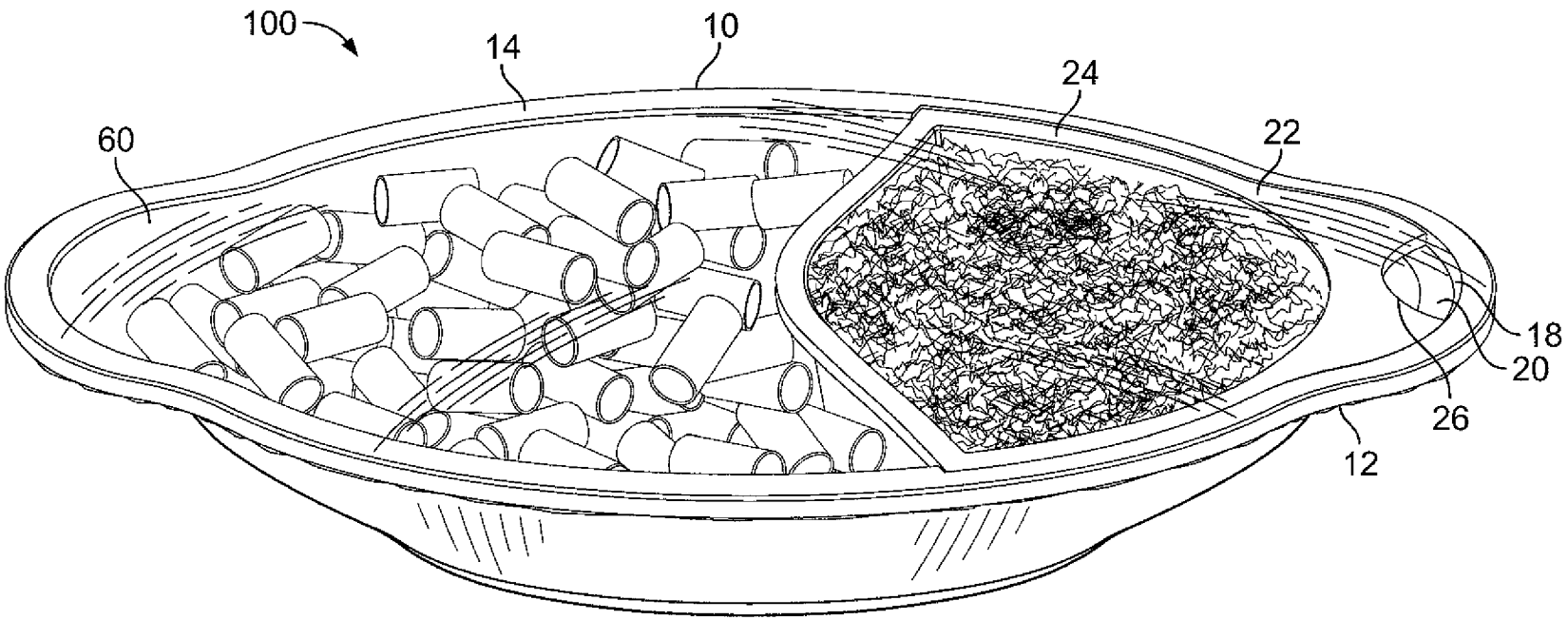
FIG. 3 is a perspective view of FIG. 2 further including a plastic film placed over the containers to seal the contents similar to packaging of the containers.
Figure 4:
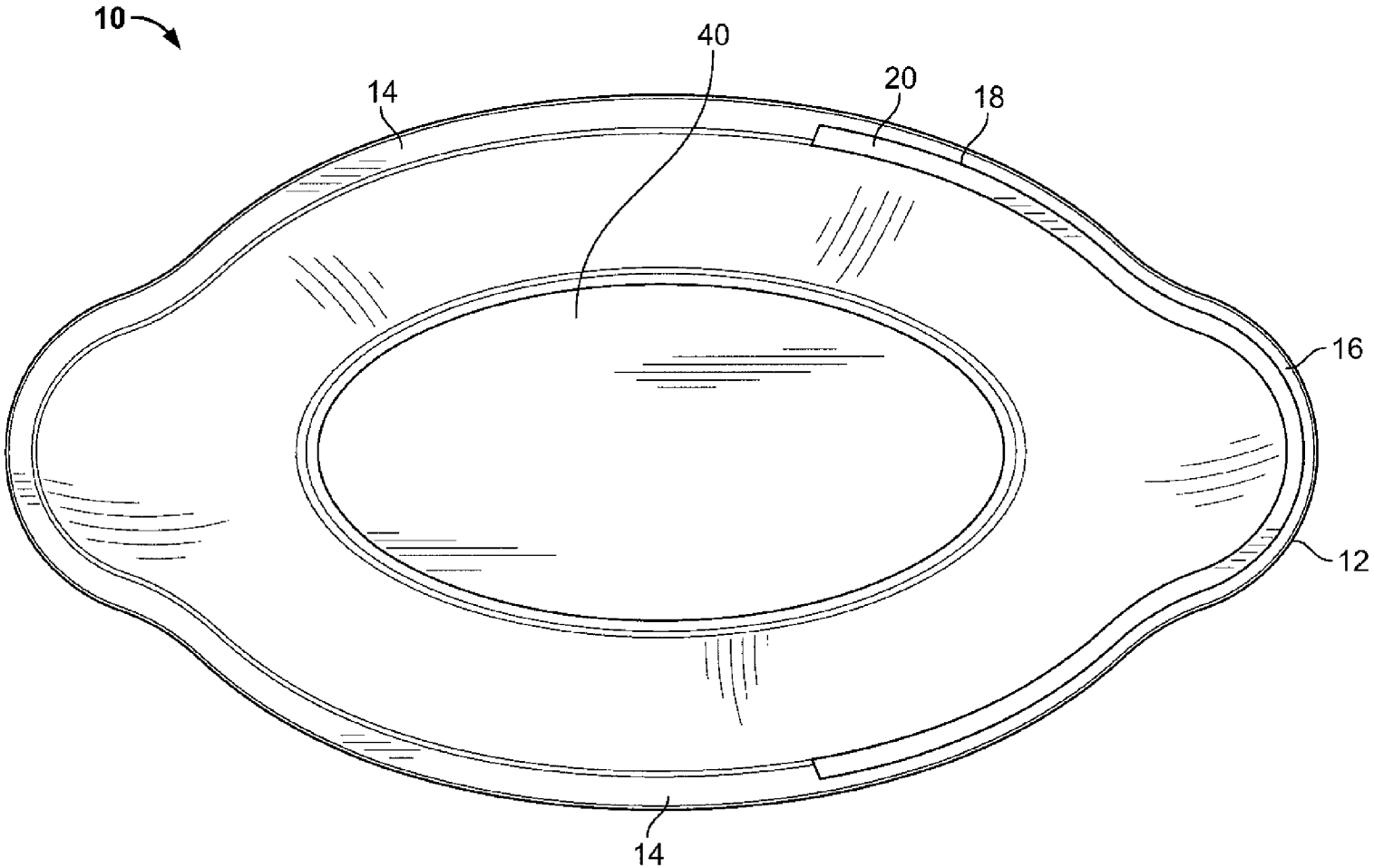
FIG. 4 is a top view of the main container empty.
Figure 5:
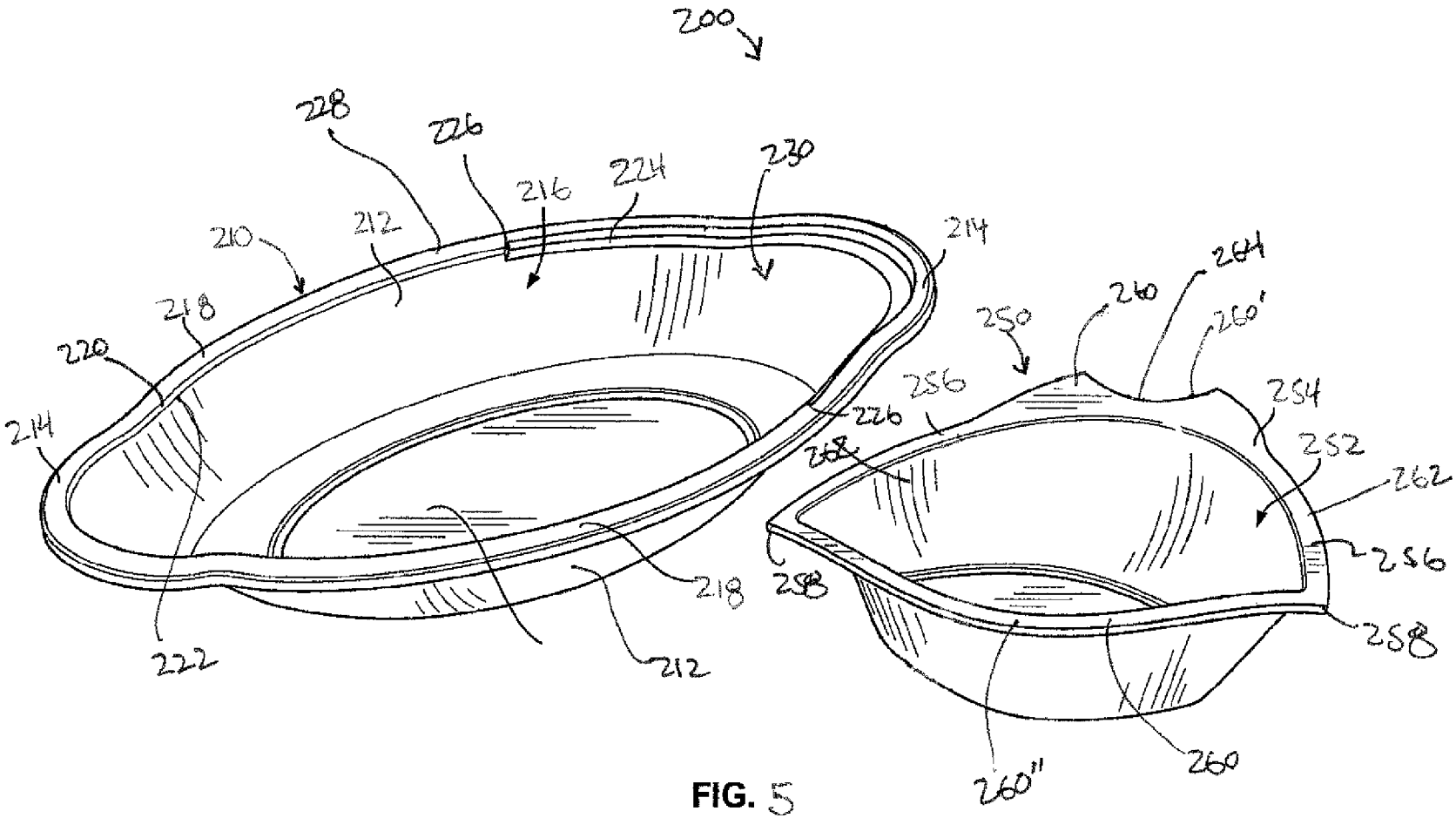
FIG. 5 is a perspective view of the containers in an empty state and separated from one another in accordance to a second embodiment of the present invention.

Referring now to FIGS. 2 and 3, when packaged the prepackaged container 100 includes a main container 10 with a smaller container 22 nested in it. The smaller container is filled with a secondary item such as but not limited to, sauces, vegetables, and/or meat, and placed within the main container. An area 28 of the main container 10 not occupied by the smaller container 22 will include a main food item, such as but not limited to pasta, or rice or other contents. Both containers are then sealed with one film 60 and can go through desired thermal process. Before consumption, a consumer will place the package in a microwave to warm up the contents. The film 60 may be removed or openings in the film may be required depending upon the cooking instructions. In addition, water may need to be added to the area 28.

Once heated, the smaller container 22 is removed from the main container 10 by grasping the notch 26 and the opposite end 30 of the smaller container 22. Once the smaller container 22 is removed, the area that was filed by the smaller container 22 becomes an empty area that can quickly be filed with the contents from the main container. This may occur naturally as the contents of the main container may redistribute or the user may have to move the contents around. However, after the contents from the main container redistribute, a head space above the contents will be created in the main container 10 above the contents. The contents from the smaller container 22 may then be poured or dumped into the main container. Moreover, since the contents of the smaller container 22 occupied a space within the main container 10, when added to the main container 10, the total space occupied by both the contents from the smaller container and the main container 10 will not overflow the main container 10. Thus the user will have space in the main container 10 to mix and stir the combined contents without spilling.

Continuing to refer to FIGS. 1-4 and 5, in another aspect of the invention the microwavable container system 200, includes a base container 210 and a tray (or smaller container) 250. The base container 210 includes a pair of sides 212 and a pair of oval shaped diametrically opposed ends 214. The sides and oval ends define a base interior cavity 216. The base container 210 further includes a continuous outwardly turned edge 218 extending from an inner periphery 220. The inner periphery 220 emanates from a top portion 222 of the pair of sides 212 and the oval shaped ends 214. The base container further includes an inwardly turned ledge 224 defined along the inner periphery 220. The ledge 224 extends about one of the oval shaped ends 214. Starting from the oval shaped end the ledge extends therefrom along the inner periphery 220 of the pair of sides 212 and terminates at a pair of terminals 226. The terminals 226 end along the pair of sides 212 prior to a mid-point 228 defined between the pair of oval shaped ends 214.

The tray 250, which defines a tray interior cavity 252, is as previously shown, disposed within a first portion 230 of the base interior cavity 216. The tray 250 includes a pair of diametrically opposed ends 260 and a pair of sides 262 positioned therebetween. Along one of the opposed ends 260' can be positioned a notch 264, while the other opposed end 260" is an outwardly bowed end. The tray 250 further includes an upper outwardly turned edge 254, with a pair of side edges 256 running along the pair of sides 262. The side edges 256 are sized complementary to rest on the ledge 224 when the tray is disposed within the first portion 230 of the base interior cavity 216. In addition, when positioned therein, the side edges 256, which include ends 258, substantially abut the terminals 226 of the ledge to ensure the tray does not fall out of its engagement with the base container.

Figure 6:
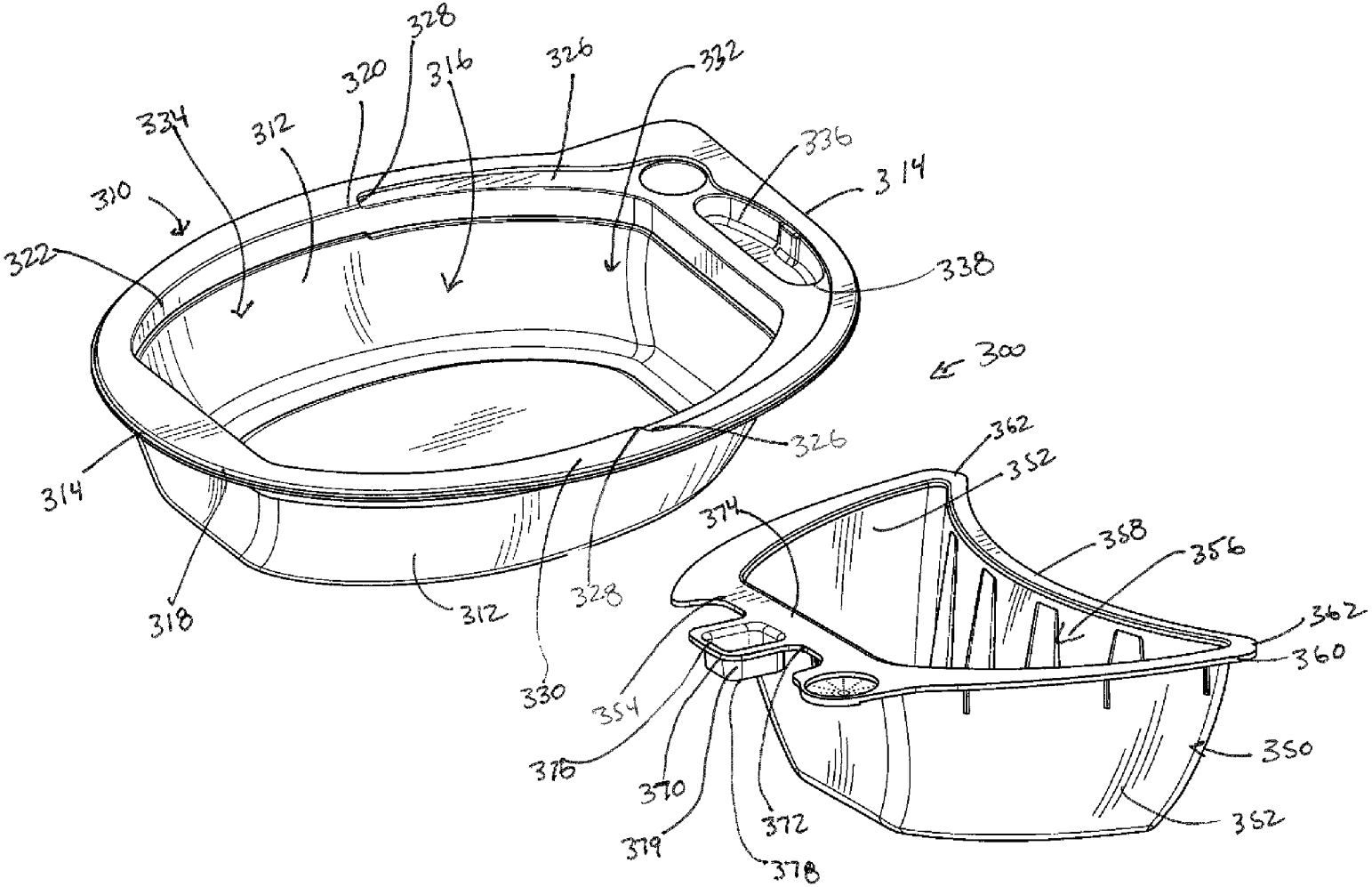
FIG. 6 is a perspective view of the containers in an empty state and separated from one another in accordance to a third embodiment of the present invention.
Figure 7:
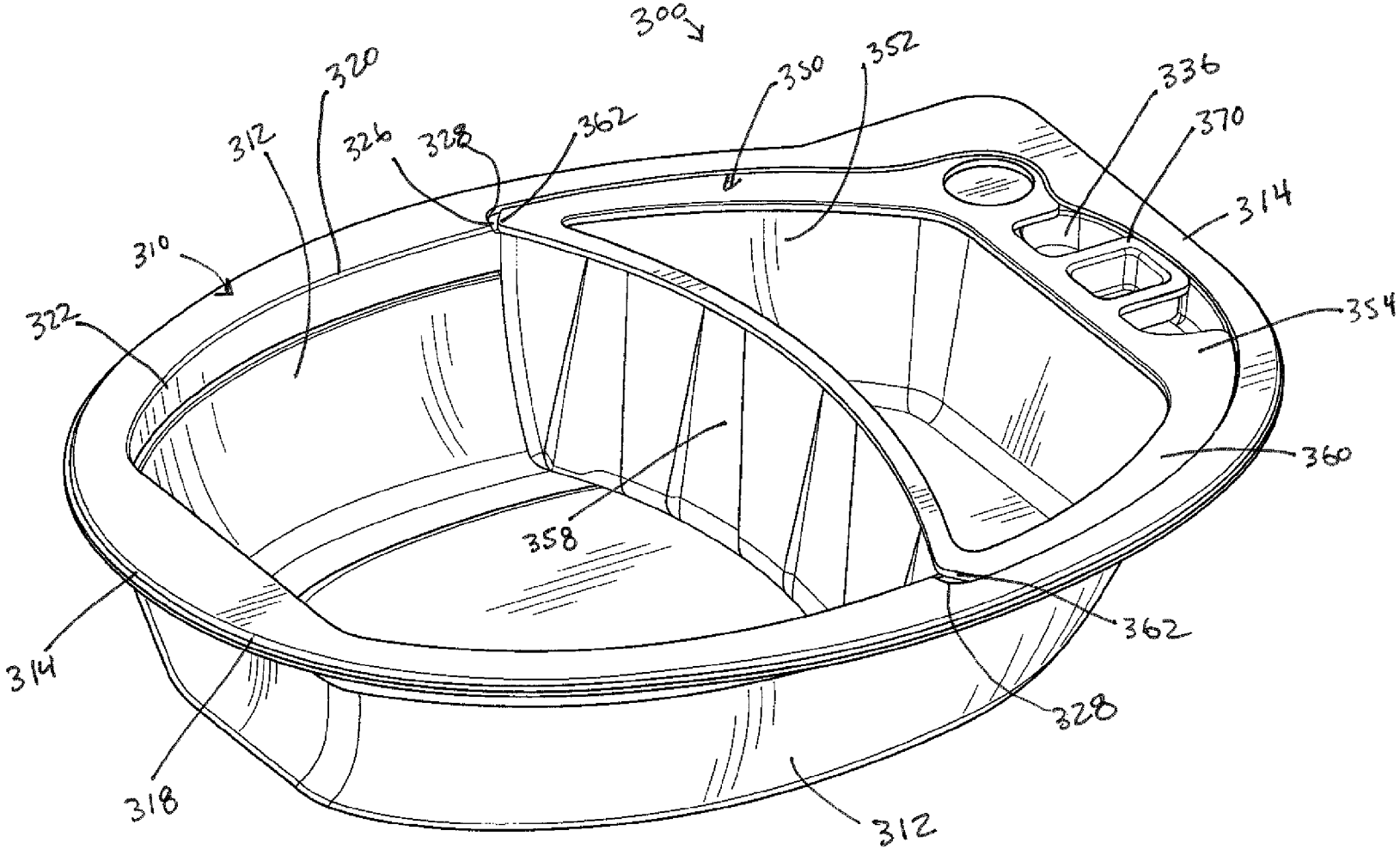
FIG. 7 is a perspective view of an embodiment in accordance with the third embodiment showing the smaller container nested within the main container.
Figure 8:
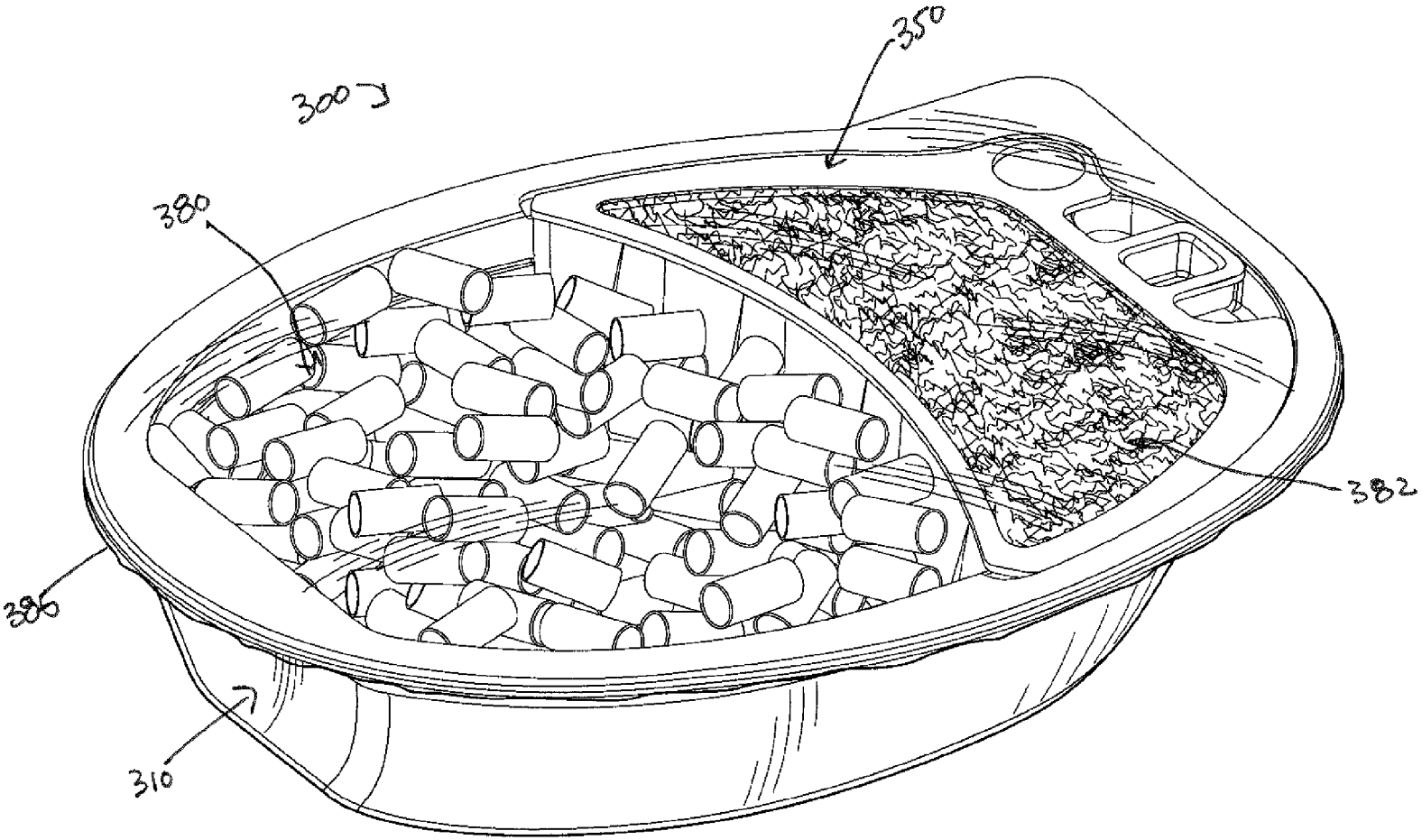
FIG. 8 is a perspective view of FIG. 7 further including a food contents and a plastic film placed over the containers to seal the contents similar to packaging of the containers.

Referring now to FIGS. 6-8, there is shown another embodiment of the present invention, defined as a microwavable container system 300. The container 300 includes a base container 310 and a tray 350. The base container 310 has a pair of sides 312 and a pair of substantially rounded shaped diametrically opposed ends 314 for defining a base interior cavity 316. The base container 310 further has a continuous outwardly turned edge 318 extending from an inner periphery 320 of the base container 310. The inner periphery 320 is defined along a top portion 322 of the pair of sides 312 and rounded shaped ends 314.

The base container further includes an indented ledge 326 defined in the inner periphery 320. The indented ledge 326 does not extend entirely around the base container, rather it extends only about one of the rounded shaped ends in the base container. As illustrated, the indented ledge 326 extends along the inner periphery 320 away from the rounded shaped end and continues along the inner periphery about the pair of sides 312 to a pair of terminals 328. The terminals 328 end along the pair of sides 312 prior to a mid-point 330 defined between the pair of rounded shaped diametrically opposed ends 314.

The tray 350 is disposed within a first portion 332 of the base interior cavity 316 of the base container 310. The tray 350 having a pair of tray sides 352 and a pair of diametrically opposed tray ends 354 positioned between the tray sides for defining a tray interior cavity 356. In addition, one of the opposed tray ends has an inwardly bowed profile 358. The tray 350 includes an upper outwardly turned edge 360 sized complementary to rest on the ledge 326 when the tray 350 is disposed within the first portion 332 of the base interior cavity 316 of the base container 210. The outwardly turned edge 360 includes ends 362 substantially abutting the terminals 328 of the ledge 326, wherein the inwardly bowed profile 358 of the opposed tray end is positioned prior to and towards the mid-point 330 in the base container 310.

A second portion 334 of the base interior cavity 316 not occupied by the tray 350 includes a first food component 380. And the tray 350 interior cavity 356 includes a second food component 382, that are combinable after microwave cooking by removing the tray 350 from the base interior cavity 316 and adding the contents of the second food component 380 with the contents of the first food component 380 in the base interior cavity which becomes larger with the removal of the tray 350. For storage and possible cooking purposes, the microwaveable container system 300 may further include a removable plastic film 386 securable onto the upper outwardly turned edge 318 defined by the base container 310.

In other aspects of this embodiment, the base container 310 includes a notched depression 336 on a portion 338 of the indented ledge 326 primarily about the rounded shaped end 314 in the base container 310. The tray 350 could then further include at least one member 370 protruding from a portion 372 of the outwardly turned edge 360 on a side 374 opposite the end with the inwardly bowed profile 358. The at least one member 370 if defined to include an upper area 376 and a lower area 378 depending from a sidewall 379 with a sidewall depth defined such that the lower area of the at least one member is received within the notched depression, the protruding member 370 could be defined as a small holding compartment for spices or other ingredients that could be added to the food compartments as directed.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A microwavable container system comprising:

a base container, having a pair of sides and having a pair of substantially rounded shaped diametrically opposed ends for defining a base interior cavity, the base container further having a continuous outwardly turned edge extending from an inner periphery of the base container, the inner periphery defined along a top portion of the pair of sides and rounded shaped ends;

a tray disposed within a first portion of the base interior cavity of the base container, the tray having a pair of tray sides and a pair of diametrically opposed tray ends positioned between the tray sides for defining a tray interior cavity, and wherein one of the opposed tray ends has an inwardly bowed profile;

wherein the base container further includes an indented ledge defined in the inner periphery about only one of the rounded shaped ends in the base container, the ledge extends along the, inner periphery away from the rounded shaped end and continues along the inner periphery about the pair of sides to a pair of terminals, the terminals ending along the pair of sides prior to a mid-point defined between the pair of rounded shaped diametrically opposed ends, and wherein the tray includes an upper outwardly turned edge sized complementary to rest on the ledge when the tray is disposed within the first portion of the base interior cavity of the base container, and the outwardly turned edge includes ends substantially abutting the terminals of the ledge, wherein the inwardly bowed profile of the opposed tray end is positioned prior to and towards the mid-point in the base container; and wherein a second portion of the base interior cavity not occupied by the tray includes a first food component, and wherein the tray interior cavity includes a second food component, that are combinable after microwave cooking by removing the tray from the base interior cavity and adding the second food component with the first food component in the base interior cavity which becomes larger with the removal of the tray.

2. The microwaveable container system of claim 1, wherein the base container includes a notched depression on a portion of the indented ledge about the rounded shaped end in the base container.

3. The microwaveable container system of claim 2, wherein the tray includes at least one member protruding from a portion of the outwardly turned edge on a side opposite the end with the inwardly bowed profile, the at least one member defined to include an upper area and a lower area depending from a sidewall with a sidewall depth defined such that the lower area of the at least one member is received within the notched depression.

4. The microwaveable container system of claim 1 further comprising a removable plastic film securable onto the upper outwardly turned edge defined by the base container.

5. A microwavable container system comprising:

a base container, having a pair of sides and having a pair of rounded shaped diametrically opposed ends for defining a base interior cavity, the base container further having a continuous outwardly turned edge extending from an inner periphery of the base container, the inner periphery defined along a top portion of the pair of sides and rounded shaped diametrically opposed ends, and wherein the base container further includes an indented ledge defined in the inner periphery about only one of the rounded shaped ends in the base container, the ledge extends along the inner periphery away from the rounded shaped end and continues along the inner periphery about the pair of sides to a pair of terminals, the terminals ending along the pair of sides about a mid-point defined between the pair of rounded diametrically opposed ends; and a tray disposed within a first portion of the base interior cavity of the base container, the tray having a pair of tray sides and a pair of diametrically opposed tray ends positioned between the tray sides for defining a tray interior cavity, and wherein one of the opposed tray ends has an inwardly bowed profile, and wherein the tray includes an upper outwardly turned edge sized complementary to rest on the ledge when the tray is disposed within the first portion of the base interior cavity of the base container, and the outwardly turned edge includes ends substantially abutting the terminals of the ledge, wherein the inwardly bowed profile of the opposed tray end is positioned about and towards the mid-point in the base container.

6. The microwaveable container system of claim 5, wherein a second portion of the base interior cavity not occupied by the tray includes a first food component, and wherein the tray interior cavity includes a second food component, that are combinable after microwave cooking by removing the tray from the base interior cavity and adding the second food component with the first food component in the base interior cavity which becomes larger with the removal of the tray.

7. The microwaveable container system of claim 5, wherein the base container includes a notched depression on a portion of the indented ledge about the rounded shaped end in the base container.

8. The microwaveable container system of claim 7, wherein the tray includes at least one member protruding from a portion of the outwardly turned edge on a side opposite the end with the inwardly bowed profile, the at least one member defined to include an upper area and a lower area depending from a sidewall with a sidewall depth defined such that the lower area of the at least one member is received within the notched depression.

9. The microwaveable container system of claim 8 further comprising a removable plastic film securable onto the upper outwardly turned edge defined by the base container.

* * * * *